US007270787B2

(12) United States Patent
Romanauskas et al.

(10) Patent No.: US 7,270,787 B2
(45) Date of Patent: Sep. 18, 2007

(54) CENTRIFUGE SAMPLE JAR AND CLOSURE

(75) Inventors: William Romanauskas, Southbury, CT (US); Edward Sheeran, Southbury, CT (US)

(73) Assignee: Thermo Fisher Scientific (Asheville) LLC, Asheville, NC (US)

( * ) Notice: Subject to any disclaimer, the term of this patent is extended or adjusted under 35 U.S.C. 154(b) by 297 days.

(21) Appl. No.: 10/630,675

(22) Filed: Jul. 31, 2003

(65) Prior Publication Data

US 2005/0025674 A1 Feb. 3, 2005

(51) Int. Cl.
*B01L 3/02* (2006.01)

(52) U.S. Cl. ..... 422/100; 422/99; 422/101; 422/102; 220/46; 215/40

(58) Field of Classification Search ..... 422/61, 422/99–102; 220/46; 215/40
See application file for complete search history.

(56) References Cited

U.S. PATENT DOCUMENTS 3,635,370 A * 1/1972 Romanauskas ..... 220/227
6,872,358 B2 * 3/2005 Hagen et al. ..... 422/61

FOREIGN PATENT DOCUMENTS

EP 139289 * 10/1984

* cited by examiner

*Primary Examiner*—Jill Warden
*Assistant Examiner*—Jyoti Nagpaul
(74) *Attorney, Agent, or Firm*—Baker & Hostetler LLP

(57) ABSTRACT

A centrifuge sample jar configured to maximize processed sediment accessibility and minimize leakage.

19 Claims, 10 Drawing Sheets

CENTRIFUGE SAMPLE JAR AND CLOSURE

FIELD OF THE INVENTION

The present invention relates generally to container. More particularly, the present invention relates to a centrifuge sample container.

BACKGROUND OF THE INVENTION

A centrifuge rotor is a relatively massive member in which a liquid sample is exposed to a centrifugal force field. The liquid sample is carried in a container for use in swinging bucket, vertical or fixed angle centrifuge rotor. Often the sample may contain biologically hazardous material whose escape from the container may present a health or safety threat to the user of the centrifuge instrument.

Current conventional centrifuge container designs primarily for manufacturing reasons are derivations of simple laboratory wash bottles and are not specifically designed to withstand centrifugal forces. As a result these containers require separate structures to support the container neck and the necked down container mouth present difficulties in the removal of processed sediments.

In order to prevent leakage or aerosoling of the liquid from the container O-ring members are typically employed to insure sealed engagement between the container and its cover. The O-ring seal is usually disposed in a circumferentially extending groove located on the container open end. The location of this groove exposes it to damage due to handling which also contributes to container leakage.

In addition, conventional centrifuge container closures employ a "crush" O-ring seal that is dependent on torque applied to closure and therefore variable. This variability contributes greatly to container leakage.

In view of the foregoing it is believed to be advantageous to provide a method and apparatus for holding a sample within a centrifuge instrument that is configured in a manner that facilitates accessibility as well as reduced leakage.

SUMMARY OF THE INVENTION

The foregoing needs are met, to a great extent, by the present invention, wherein in one aspect an apparatus is provided that in some embodiments a method and apparatus for holding a sample within a centrifuge instrument that is configured in a manner that facilitates accessibility as well as reduced leakage.

In accordance with one aspect of the present invention, a centrifuge sample jar and closure specifically designed to minimize sealing area distortion by the elimination of all unnecessary support interfaces and thus their associated dimensional tolerances are provided. This is accomplished by having the entire length of the jar be of one diameter, and be completely supported by the rotor cavity. This requires that the jar closure fit inside the jar rather than on the outside of the necked down portion as in present designs.

In accordance with another aspect of the present invention, a simple O-ring piston seal having an O-ring groove to minimize void volume and having an outer diameter as large as possible is used as the sealing element. The reason for this is that operating centrifugal body forces acting on the O-ring material will force it into any existing void volume resulting from groove design, tolerances, clearances, and distortion at the greatest distance from rotational axis. As void volume is filled on the outboard side, the O-ring cross-sectional area is reduced on the inboard side. In conventional designs because of smaller neck diameters the inboard side is also under fluid pressure resulting in potential leaks on the inboard side. In the present invention design, the reduced inboard section of the O-ring is not subjected to any fluid pressure. Having an excess of jar volume over and above the desired fluid volume insures this result.

In accordance with yet another aspect of the present invention, an interrupted bayonet type closure is used in order to avoid both having to decant fluid over the closure retainer threads, and having to use multiple closure turns to effect a seal. The completeness of the closure and open position is determined by positive stops. A conventional piston type O-ring seal does not allow easy insertion of closure due to the required O-ring cross-sectional squeeze needed to effect a seal and the cumulative fit tolerances. To overcome this a spring element is incorporated to provide a transverse squeeze to effect the seal. In one embodiment the transverse squeeze is applied by a threaded element. The resulting seal is dynamic in that the greater the pressure to be sealed the greater the resulting sealing force. A flexible ring is also incorporated in the closure to completely encapsulate the O-ring thus eliminating the potential for O-ring material to extrude from the O-ring groove.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
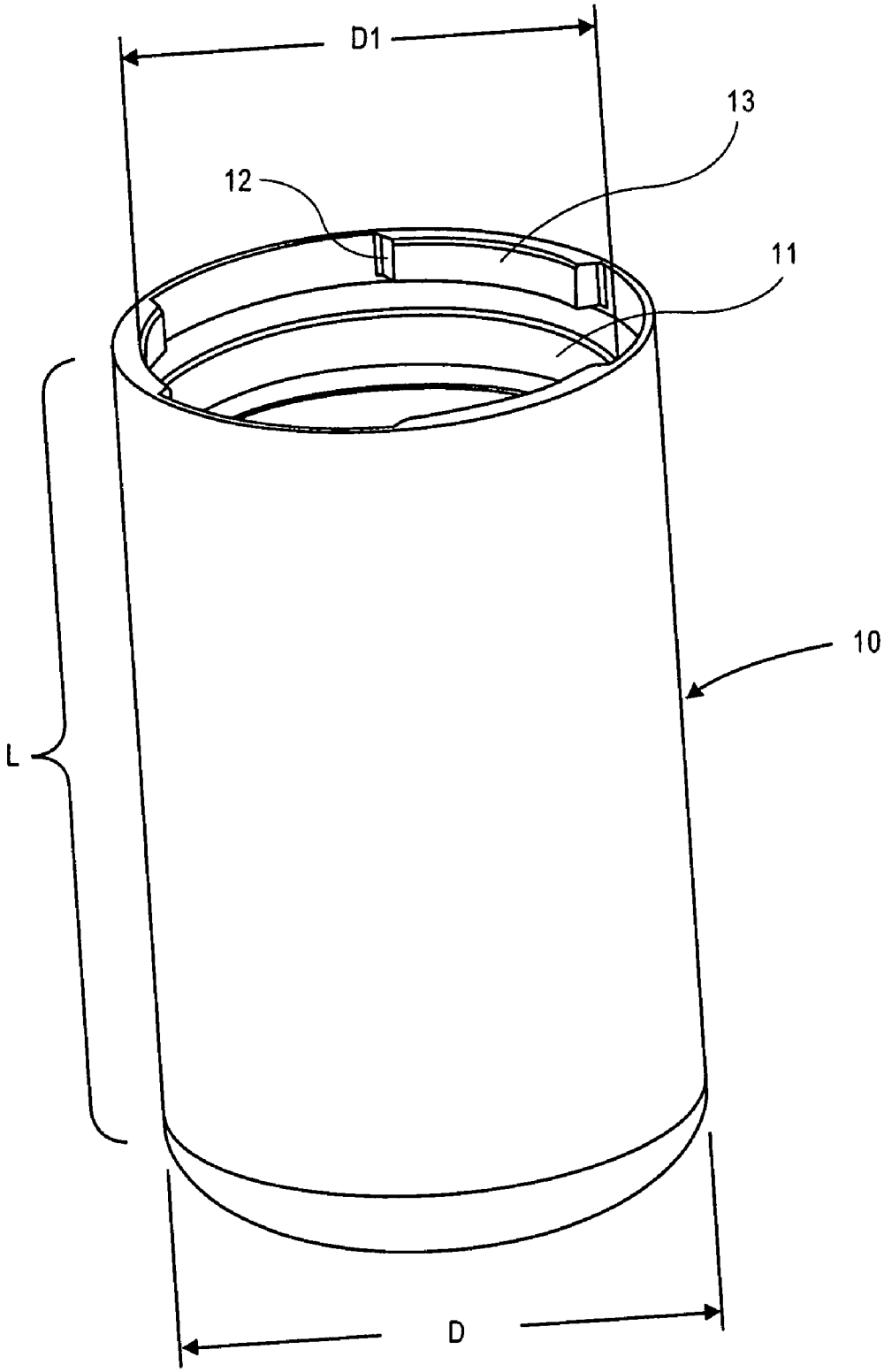
FIG. 1 is centrifuge sample container in accordance with one embodiment of the invention.
Figure 2:
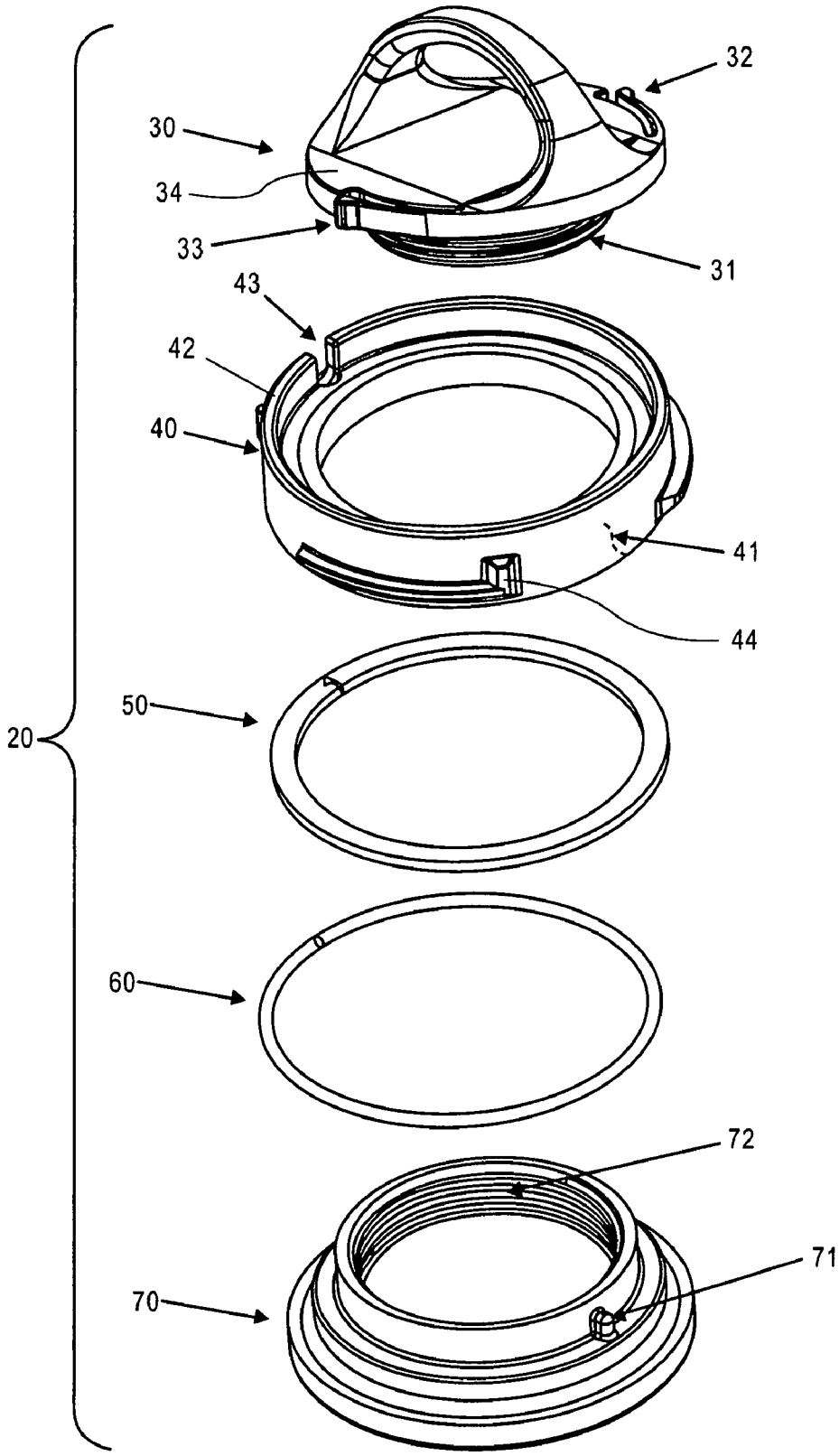
FIG. 2 is an exploded view of closure assembly in accordance with one embodiment of the invention.
Figure 3:
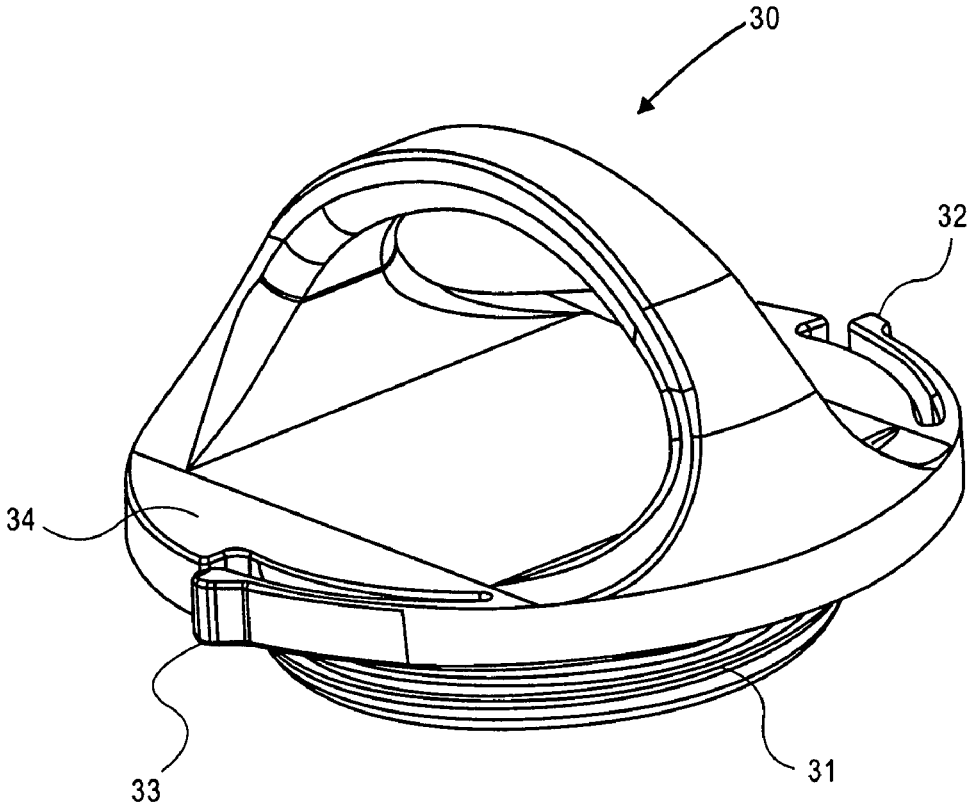
FIG. 3 is a cap of closure assembly.
Figure 4:
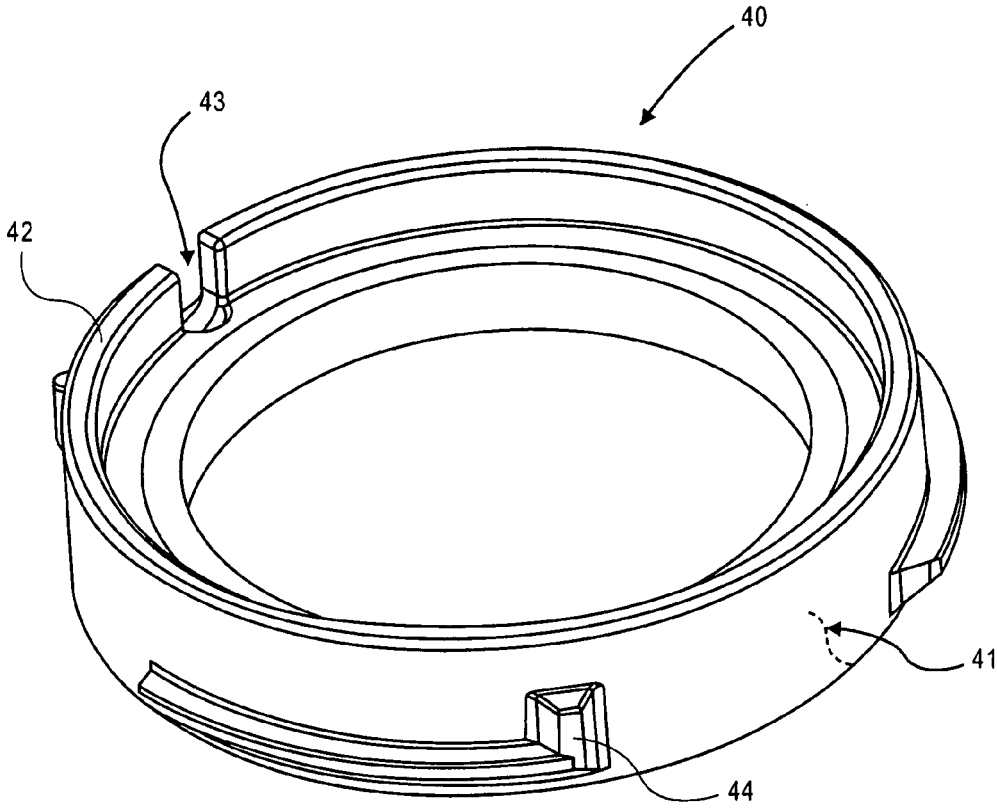
FIG. 4 is a flange component of closure assembly.
Figure 5:
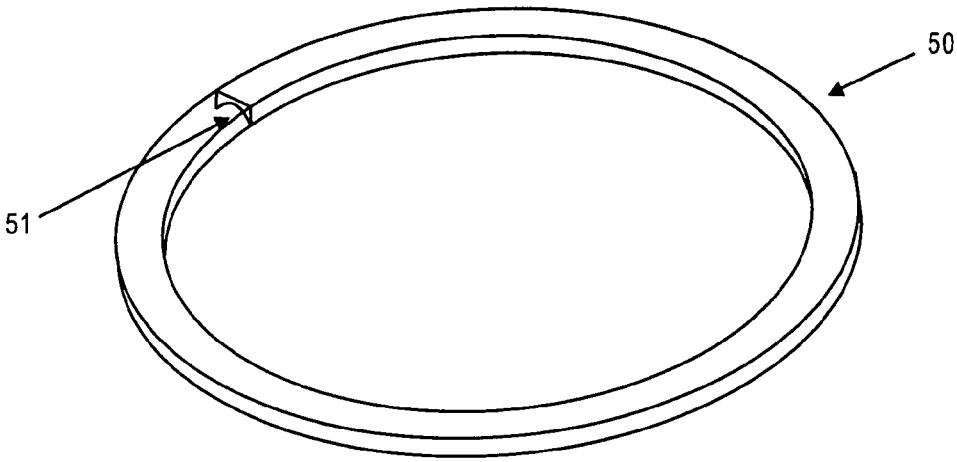
FIG. 5 is a flexible ring of closure assembly.
Figure 6:
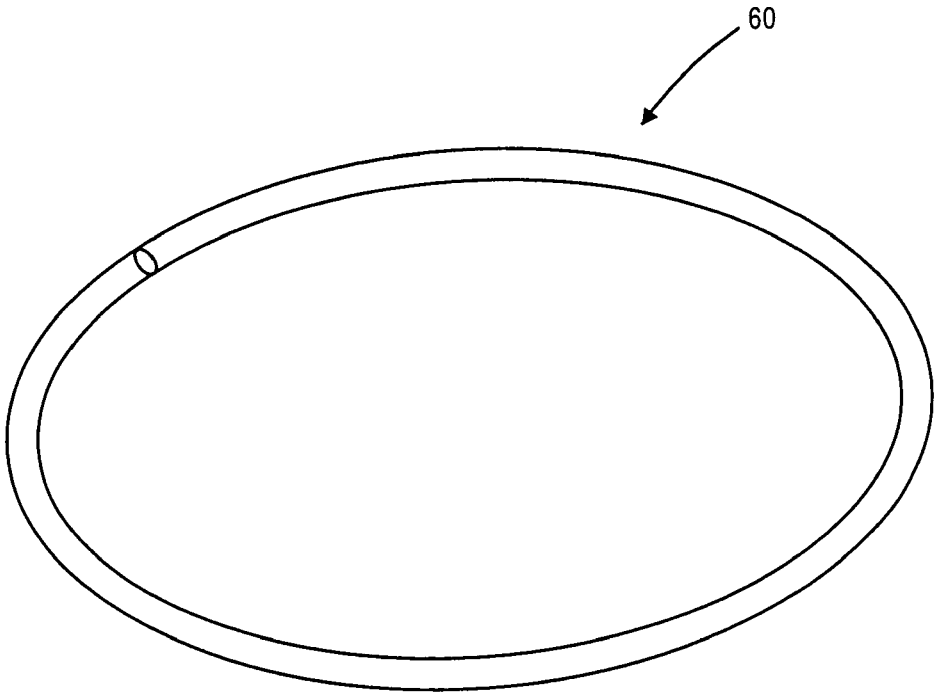
FIG. 6 is an O-ring of closure assembly.
Figure 7:
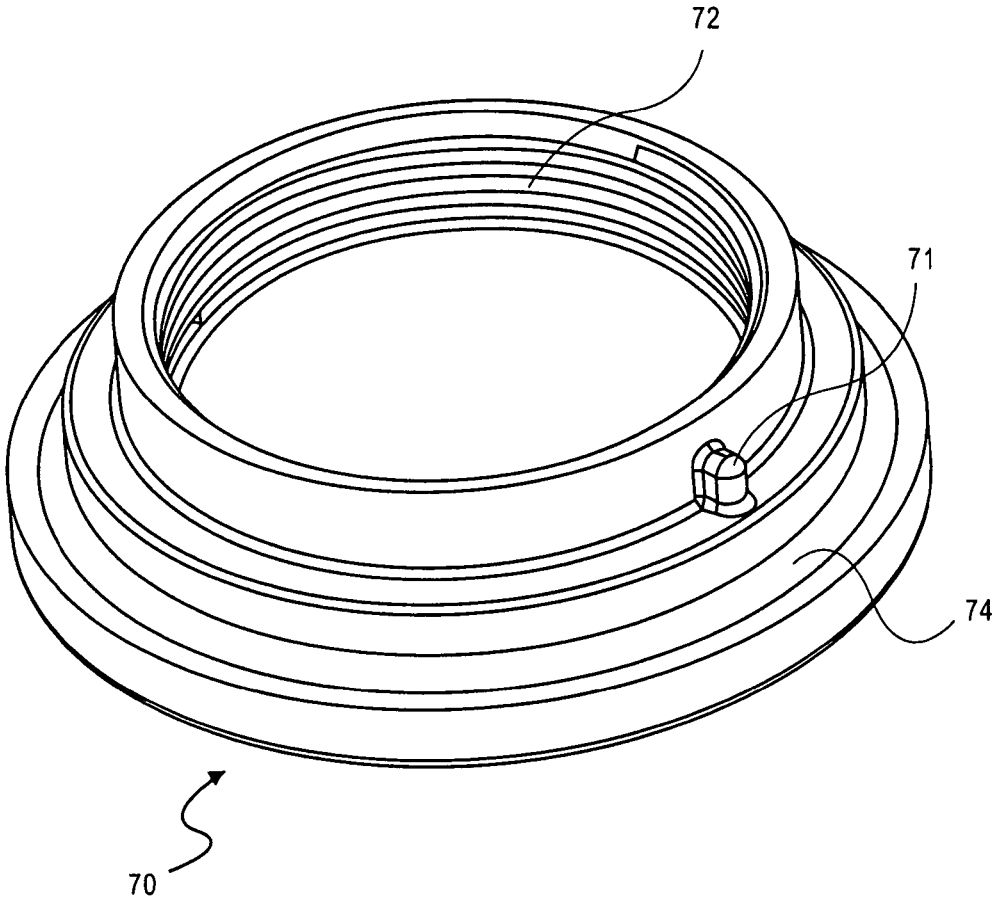
FIG. 7 is a bottom of closure assembly.

The invention will now be described with reference to the drawing figures, in which like reference numerals refer to like parts throughout. An embodiment in accordance with the present invention provides a centrifuge sample jar and closure specifically designed to minimize sealing area distortion by the elimination of all unnecessary support interfaces and thus their associated dimensional tolerances.

Referring to FIG. 1, the entire length L of centrifuge sample container 10 is the same diameter D so that it can be fully supported by rotor cavity (not shown). An O-ring piston seal is created on seal surface 11 that has an inside diameter D1 as large as possible so that any inboard O-ring void would not be in fluid contact. Sample container 10 further includes a vertical surface 12 and lug 13.

Referring to FIGS. 2-7, the closure assembly 20 would engage the centrifuge sample container 10 in an interrupted bayonet fashion. The completeness of closed and open position of closure is evident by a positive stop. The closure assembly 20 consists of a handle 30, flange 40, flexible ring 50, O-ring 60, and bottom 70. The O-ring 60 and flexible ring 50, concave surface 51 adjacent to O-ring 60, is placed onto bottom 70. The flange 40 is then inserted onto the bottom 70 so that the key 71 engages the slot 41 on the underside of the flange 40, sandwiching the O-ring 60 and flexible ring 50 in-between. This key/slot engagement prevents rotation of bottom 70 relative to flange 40. The handle thread 31 of handle 30 is threaded into bottom thread 72 of bottom 70. The closed finger 33 and open finger 32 must be depressed inward during threading until surface 34 of handle 30 is flush with surface 42 of flange 40.

In operation, the closure assembly 20 is in the open position when the open finger 32 is inside slot 43 of flange 40. In the open position, the closure assembly 20 is inserted into mouth of centrifuge sample container 10. The closure assembly will freely pass into the sample container 10 since the O-ring is not compressed. The closure assembly 20 is then rotated clockwise until the stop 44 on the flange 40 strikes the vertical surface 12 of the lug 13 on centrifuge sample container 10. Continuing to rotate the closure assembly 20 results in the bottom 70 to be drawn upward until the closed finger 33 comes to a firm stop in slot 43 of flange 40 providing a transverse squeeze on the O-ring 60 to effect the static seal.

Figure 8:
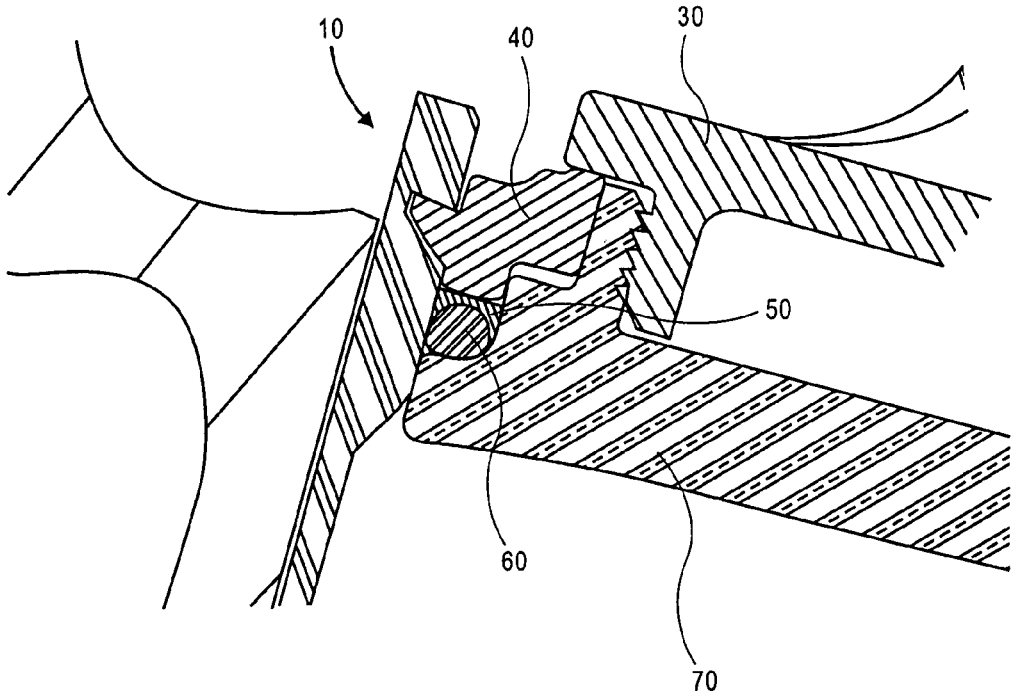
FIG. 8 is a cross-sectional view of the closure assembly showing components and the O-ring in a static closed position.
Figure 10:
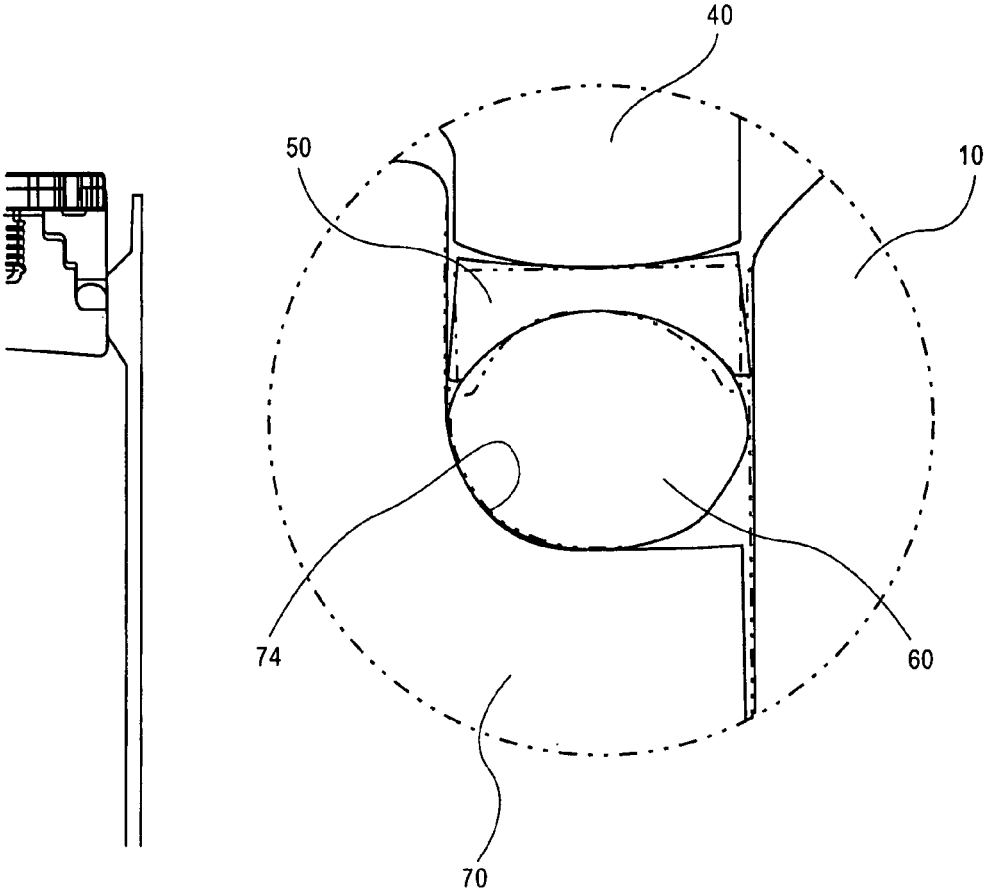
FIG. 10 is an enlarged cross-sectional view of the O-ring and the flexible ring of the closure in dynamic closed position subjected to fluid pressure.

Referring to FIG. 8, the compressed O-ring 60 to effect the static seal. In FIG. 10, the flexible ring 50 is depicted in phantom lines for the static seal position.

Figure 9:
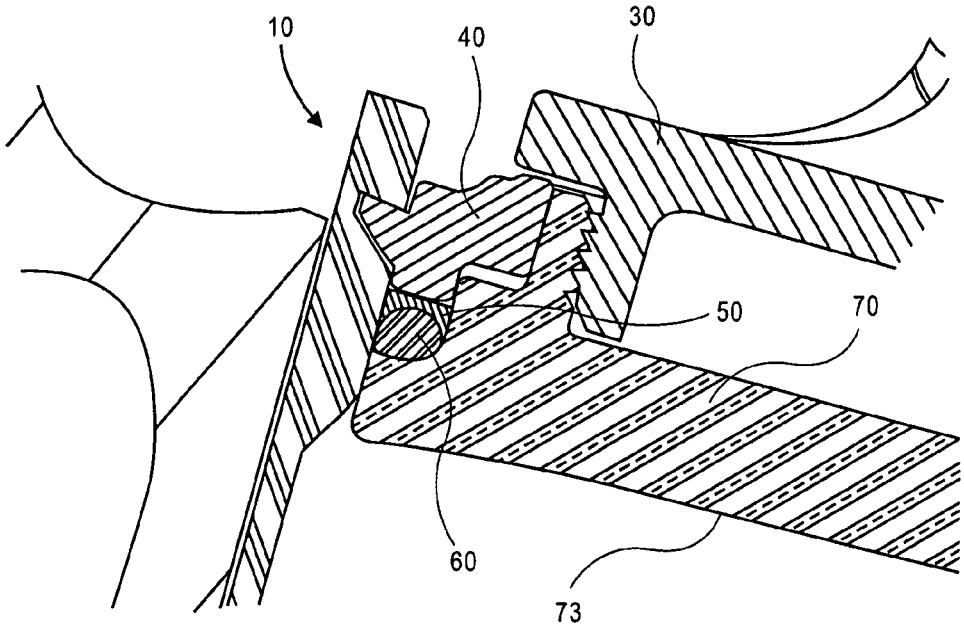
FIG. 9 is a cross-sectional view of the closure assembly showing components and the O-ring in a dynamic closed position subjected to fluid pressure.

Referring to FIG. 9, during centrifugation the increasing fluid pressure acting on the underside surface 73 of the bottom 70 causes both the handle 30 and bottom 70 to move away from the fluid pressure resulting in a greater sealing force of O-ring 60 on seal surface 11 of centrifuge sample container 10.

Again referring to FIG. 9, a more compressed O-ring 60 to fill remaining void volume effecting a dynamic seal in that the greater the pressure to be sealed the greater the resulting sealing force.

Referring to FIG. 10, the flexible ring 50 is depicted in solid lines in the dynamic seal position. In this position the flexible ring 50 completely encapsulates the O-ring 60 material thus eliminating the potential for O-ring material to extrude from the O-ring groove 74.

Although an example of the sample container 10 is shown using closure assembly 20, it will be appreciated that other closures can be used. Also, although the sample container 10 is useful to hold centrifuge samples it can also be used to transport and transfer items that may be pressure sensitive or leak sensitive in nature.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A sample container, comprising:

a closed end;

an opened end;

a closure assembly, wherein said closed end and said opened end are substantially equal in diameter and said closure assembly releasably seals said opened end; and wherein said closure assembly comprises:

a handle having threads, said handle comprises a closed finger for locking and an open finger for unlocking said closure assembly on said container;

a flange;

a hold down ring;

a sealing ring; and a bottom support of said closure assembly having threads to releasably mate with the handle wherein the flange is configured to mate with the opened end and the hold down ring and the sealing ring are disposed between the bottom support, the flange and the opened end.

2. The container of claim 1, wherein said container is cylindrical.

3. The container of claim 1, wherein said container further includes a lug surface and a vertical inner surface disposed at said opened end.

4. The container of claim 1, wherein said hold down ring is a flexible material.

5. The container of claim 4, wherein said hold down ring is concave on one side.

6. The container of claim 1, wherein said sealing ring is an 0-ring.

7. The container of claim 1, wherein said flange includes at least one stop and at least one slot.

8. The container of claim 1, wherein said handle includes a male threaded bottom surface.

9. The container of claim 8, wherein said bottom support includes a key protrusion and a female threaded top surface.

10. The container of claim 1, wherein the hold down ring and sealing ring are placed in a space defined by the container, the flange, and the bottom support.

11. A method of sealing a centrifuge sample container, comprising the steps of:

providing a closure assembly comprising a handle having threads, said handle comprises a closed finger for locking and an open finger for unlocking said closure assembly on said container;

a flange;

a hold down ring;

a sealing ring; and a bottom support having threads to releasably mate with the handle;

placing said sealing ring on said bottom support;

placing said hold down ring on said sealing ring;

inserting said flange onto said bottom support sandwiching said sealing ring and said hold down ring in-between;

connecting said handle to said bottom support wherein the hold down ring and the sealing ring are disposed between the bottom support and the flange; and inserting at least most of the closure assembly into an opened end of the sample container.

12. The method of claim 11, further comprising the steps of:

rotating the closure assembly to a locked position to effect a static seal.

13. The method of claim 12, wherein said sealing ring is an O-ring.

14. The method of claim 12, wherein said hold down ring is concave on one side and is a flexible material.

15. The method of claim 12, wherein said flange includes at least one stop and at least one slot.

16. The method of claim 12, wherein said handle and said bottom support are complimentary threaded.

17. The method of claim 12, wherein said bottom support includes a key protrusion.

18. A sample container, comprising:

means for locking said container is a closed finger;

means for sealing said container wherein said means for sealing comprises:

a handle having threads;

a flange;

a hold down ring;

a sealing ring; and a bottom support having threads to releasably mate with the handle wherein the hold down ring and the sealing ring are disposed between the bottom support and the flange wherein the means for sealing said container is configured to be assembled external to the container; and means for unlocking said container is an open finger.

19. The container of claim 18, wherein said sealing ring is an O-ring.

* * * * *